US010989033B2

(12) United States Patent
Martysevich et al.

(10) Patent No.: US 10,989,033 B2
(45) Date of Patent: Apr. 27, 2021

(54) REVERSE FRAC PACK TREATMENT

(71) Applicant: Halliburton Energy Services, Inc., Houston, TX (US)

(72) Inventors: Vladimir Nikolayevich Martysevich, Spring, TX (US); Michael Wayne Sanders, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/754,717

(22) PCT Filed: Nov. 2, 2015

(86) PCT No.: PCT/US2015/058584
§ 371 (c)(1),
(2) Date: Feb. 23, 2018

(87) PCT Pub. No.: WO2017/078667
PCT Pub. Date: May 11, 2017

(65) Prior Publication Data

US 2018/0252085 A1 Sep. 6, 2018

(51) Int. Cl.
*E21B 43/267* (2006.01)
*E21B 43/08* (2006.01)
*E21B 43/02* (2006.01)

(52) U.S. Cl.
CPC ..... *E21B 43/267* (2013.01); *E21B 43/025* (2013.01); *E21B 43/08* (2013.01)

(58) Field of Classification Search
None
See application file for complete search history.

(56) References Cited

U.S. PATENT DOCUMENTS

| | | | |
|---|---|---|---|
| 5,036,917 | A | 8/1991 | Jennings, Jr. et al. |
| 6,070,666 | A | 6/2000 | Montgomery |
| 7,096,943 | B2 | 8/2006 | Hill |
| 7,290,610 | B2 | 11/2007 | Corbett et al. |
| 7,896,080 | B1 | 3/2011 | Watters et al. |

(Continued)

OTHER PUBLICATIONS

Acock et al., "Screenless Methods to Control Sand", Oilfield Review, Spring, 2003, 16 pages.

(Continued)

*Primary Examiner* — Charles R Nold
(74) *Attorney, Agent, or Firm* — Kilpatrick Townsend & Stockton LLP

(57) ABSTRACT

A treating tube may be positionable in a wellbore to create a passage internal to the treating tube and a passage in an annulus between the treating tube and a wellbore casing. Fluid may be injected into a fracturing zone from above or below a pay zone adjacent to the wellbore through a first of the two passages to expand the fracturing zone downhole or uphole, respectively, into the pay zone. Additional fluid may be injected into the pay zone through the second of the two passages to control the continued expansion of the pay zone into a desired shape. As proppant is routed through the first passage and deposited into the fractures, fluid flow in the second passage may be reversed to allow fluid to flow from the pay zone to the surface of the wellbore to control the placement of the proppant in the pay zone.

19 Claims, 11 Drawing Sheets

(56) References Cited

U.S. PATENT DOCUMENTS

| | | | | |
|---|---|---|---|---|
| 8,461,323 | B2 * | 6/2013 | Murphy | C07K 14/29 536/23.7 |
| 9,303,501 | B2 * | 4/2016 | Fehr | E21B 33/1208 |
| 2002/0096328 | A1 * | 7/2002 | Echols | E21B 43/045 166/278 |
| 2003/0141060 | A1 * | 7/2003 | Hailey, Jr. | E21B 34/06 166/278 |
| 2007/0187103 | A1 | 8/2007 | Crichlow | |
| 2012/0103603 | A1 * | 5/2012 | Broussard | E21B 23/00 166/255.1 |
| 2013/0146293 | A1 | 6/2013 | Zazovsky et al. | |
| 2013/0206400 | A1 | 8/2013 | Alexandrov et al. | |

OTHER PUBLICATIONS

Bale et al., "Propped Fracturing as a Tool for Sand Control and Reservoir Management", Society of Petroleum Engineers, Document ID SPE-24992-PA, vol. 9, No. 1, Feb. 1994, pp. 19-28.

International Patent Application No. PCT/US2015/058584, "International Search Report and Written Opinion", dated Jul. 28, 2016, 7 pages.

* cited by examiner

REVERSE FRAC PACK TREATMENT

TECHNICAL FIELD

The present disclosure relates generally to fracturing and gravel packing systems and, more particularly (although not necessarily exclusively), to methods and assemblies for proppant placement in a pay zone of a wellbore using a controlled reverse flow.

BACKGROUND

Fracturing and gravel packing (commonly known as "frac packing") is a technique combining a fracturing process (e.g., hydraulic fracturing) and a gravel packing process that may be used to complete a wellbore. For example, hydraulic fracturing may be used to stimulate the production of hydrocarbons from subterranean formations penetrated by a wellbore or to bypass damage near the wellbore. A fluid may be pumped through the wellbore and into a zone of a formation to be stimulated at a rate and pressure such that fractures are formed and extended into the zone. The gravel packing process following the fracturing treatment may allow for placing proppant around a screen in the wellbore to exclude formation sand from entering the wellbore along with the produced fluids. The proppant may function to prevent the fractures in the zone from closing, thereby providing conductive channels in the formation through which produced fluids can readily flow to the wellbore.

DETAILED DESCRIPTION

Figure 1:
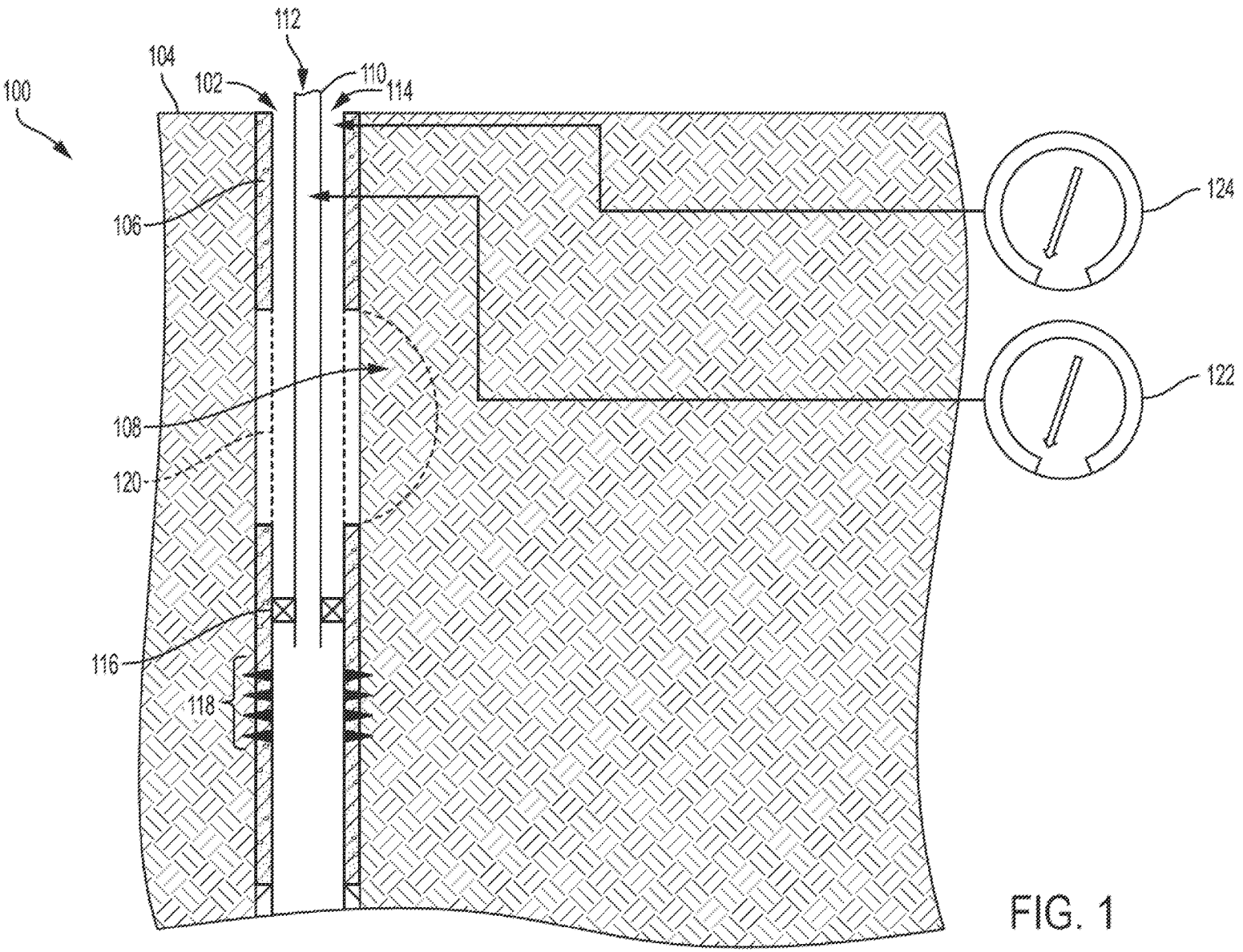
FIG. 1 is a cross-sectional schematic diagram depicting an example of a wellbore environment including a reverse frac pack treatment system for a pay zone adjacent to a wellbore according to one aspect of the present disclosure.

Certain aspects and examples of the present disclosure relate to systems and method for treating a pay zone adjacent to a wellbore using a reverse frac pack treatment system to control the expansion and shape of the pay zone. In some aspects, the pay zone may include formations adjacent to the wellbore including hydrocarbons. The frac pack treatment system may include a treating tube that may be positioned in a wellbore to create two passages for injecting fluid into the wellbore to fracture and expand the pay zone. In some aspects, the first of the two passages may be internal to the treating tube and the second passage may be an annulus between an external surface of the treating tube and a casing of the wellbore. The passages may be isolated from each other using one or more isolation devices (e.g., packers, plugs, etc.) to prevent fluid in one passage from leaking into the other. Fluid may be routed through one of the passages to fracture a zone adjacent to the wellbore and uphole or downhole of the pay zone. The fluid may be injected into the zone to create additional fractures such that the zone expands towards the pay zone. Fluid may be routed through the second of the two passages and injected into the pay zone, further expanding the pay zone to a desired size or shape.

Proppant may be routed through the first passage and into the expanded pay zone to deposit the proppant into the fractures created by the fluid. As the proppant is deposited into the pay zone through the first passage, the flow of the fluid through the second passage may be reversed such that the fluid injected into the pay zone may flow out of the pay zone and toward the surface of the wellbore through the second passage. The reverse flow of the fluid in the second passage may allow the placement of the proppant in the fractures of the pay zone to be controlled, thereby controlling the size and shape of the pay zone. In some aspects, a screen may be positioned across an opening of the pay zone. The screen may allow the fluid to flow out of the pay zone through the opening, but may prevent proppant in the pay zone from departing the pay zone through the opening.

The use of a reverse frac pack treatment system according to some aspects may allow for a placement of proppant in the pay zone with minimal equipment to control a flow back of the fluid in the pay zone. For example, a single treating tube may be positioned in the wellbore to create two passages, one of which may allow for a bi-directional flow of the fluid into and out of the pay zone. Additionally, the system according to some aspects may further allow control in the formation of the pay zone. For example, the system may be configured to allow the pay zone to be initially expanded from above or below the pay zone. Further, the system may allow the pay zone to be expanded from multiple points of entry into the pay zone via the passages created by the treating tube to expand the pay zone into a desired shape or geometry and place proppant in the pay zone in a desired manner.

The terms "inner," "outer," "internal," "external," "interior," "exterior," and "between," as used in the present disclosure may refer to a radial orientation toward or away from the center of the wellbore unless otherwise stated. The terms "uphole," "downhole," "upward," "downward," "above," and "below," as used in the present disclosure may refer to an axial orientation toward or away from the surface unless otherwise stated.

Various aspects of the present disclosure may be implemented in various environments. FIG. 1 illustrates a non-limiting example of a wellbore environment 100 that may include a reverse frac pack treatment system according to some aspects of the present disclosure. The wellbore environment 100 includes a wellbore 102 formed in a surface 104 of the earth. The wellbore 102 may be constructed in any suitable manner, such as by use of a drilling assembly having a drill bit for creating the wellbore 102. The wellbore 102 is completed with a casing 106. In some aspects, the casing 106 may include cement that is allowed to set along the wall of the wellbore. The casing 106 may perform a number of functions, including, but not limited to: (i) preventing the wellbore 102 from caving in, (ii) preventing fluids in the wellbore 102 from contaminating surrounding formations, (iii) facilitating pressure control, and (iv) providing an environment for the installation of wellbore equipment in the wellbore 102. The wellbore 102 may be positioned adjacent to a pay zone 108. In some aspects, the pay zone 108 may include a reservoir or portion of a reservoir that may be stimulated to produce hydrocarbons. In other aspects, the pay zone 108 may include any zone of interest adjacent to the wellbore 102.

In some aspects, a reverse frac pack treatment system may include a treating tube 110. The treating tube 110 may include any work string or tubing string suitable to convey a treatment in the wellbore 102. The treating tube 110 may be positioned in the wellbore 102 to create passages 112, 114. The passage 112 may be internal to the treating tube 110 and the passage 114 may be external to the treating tube 110, as shown in FIG. 1. In some aspects, the passage 112 may extend from the surface 104 of the wellbore 102 to allow fluid to be injected into the wellbore 102. The passage 114 may be an annulus created between an external surface of the treating tube 110 and the casing 106. Similar to the passage 112, the passage 114 may also extend from the surface 104 of the wellbore 102 to allow fluid to be injected into the wellbore. In some aspects, the passages 112, 114 may be connected to valves at the surface 104 of the wellbore 102 that may be used to control the flow of fluid or other materials through the passages 112, 114.

The reverse frac pack treatment system may also include one or more isolation devices 116. The passages 112, 114 may be isolated by an isolation device 116 to isolate the passages 112, 114 from one another. Isolation of the passages 112, 114 may allow the fluid flowing through the passage 112 to be separated from the fluid flowing through the passage 114. In some aspects, the separation of the fluid flowing in the passages 112, 114 may allow for a controlled injection or treatment of the wellbore 102. Non-limiting examples of isolation devices 116 may include packers, balls, plugs, bridge plugs, and wiper plugs. In some aspects, the isolation device 116 may be positioned in the passage 114 as shown in FIG. 1. In this position, the isolation device 116 may block fluid flowing into the passage 114 from flowing into a downhole portion of the wellbore 102 proximate to a downhole opening of the passage 112. The isolation device 116 may direct the fluid in the passage 114 into the pay zone 108.

The casing 106 in the downhole portion of the wellbore 102, proximate to the downhole opening of the passage 112, may include an interval having perforations 118. In some aspects, the perforations 118 may include one or more cavities or other openings in the casing 106 created by a perforation tool, such as a perforation gun. In some aspects, the perforations 118 may be positioned in the casing 106 to define an entry point for a fracturing zone in which fluid may be injected to fracture a formation adjacent to the wellbore 102. The perforations 118 are positioned below the pay zone 108 to allow the fracturing zone to be created and expanded toward to the pay zone 108 in an uphole direction. A screen 120 may be positioned uphole of the perforations 118. The screen 120 may be positioned along a cavity in the casing 106 and across an opening to the pay zone 108 created by the cavity. In some aspects, the screen 120 may include a sand control screen. In additional aspects, the screen may include a series of wire screen meshes or other material having small holes, slotted pipe, or other openings to allow certain fluids to flow between the passage 114 and the pay zone 108. The screen 120 may be positioned across the pay zone 108 as shown in FIG. 1 to allow fluid to flow between the pay zone 108 and the passage 114. But, the holes in the screen 120 may be sized to prevent proppant, sand, particles, or certain other solid materials in the pay zone 108 from exiting the pay zone 108 via the cavity in the casing 106.

In some aspects, the passages 112, 114 may be communicatively coupled to pressure-gauge assemblies 122, 124, respectively. In some aspects, the pressure-gauge assemblies 122, 124 may be positioned in the wellbore 102. In other aspects, the pressure-gauge assemblies 122, 124 may be positioned at the surface 104 of the wellbore 102. The pressure-gauge assemblies 122, 124 may be coupled to the passages 112, 114 via one or more suitable communication lines or via a wireless connection. In one example, the pressure-gauge assemblies 122, 124 may include sensors positioned in the passages 112, 114, respectively. The sensors may be connected to a processing device positioned at the surface 104 of the wellbore 102 and configured to interpret the readings of the sensors to determine a real-time measurement of the pressure in the respective passages 112, 114. In some aspects, the pressure in the passages 112, 114 may indicate or correspond to a condition in the pay zone 108 or a stage in the frac pack treatment process.

Figure 2:
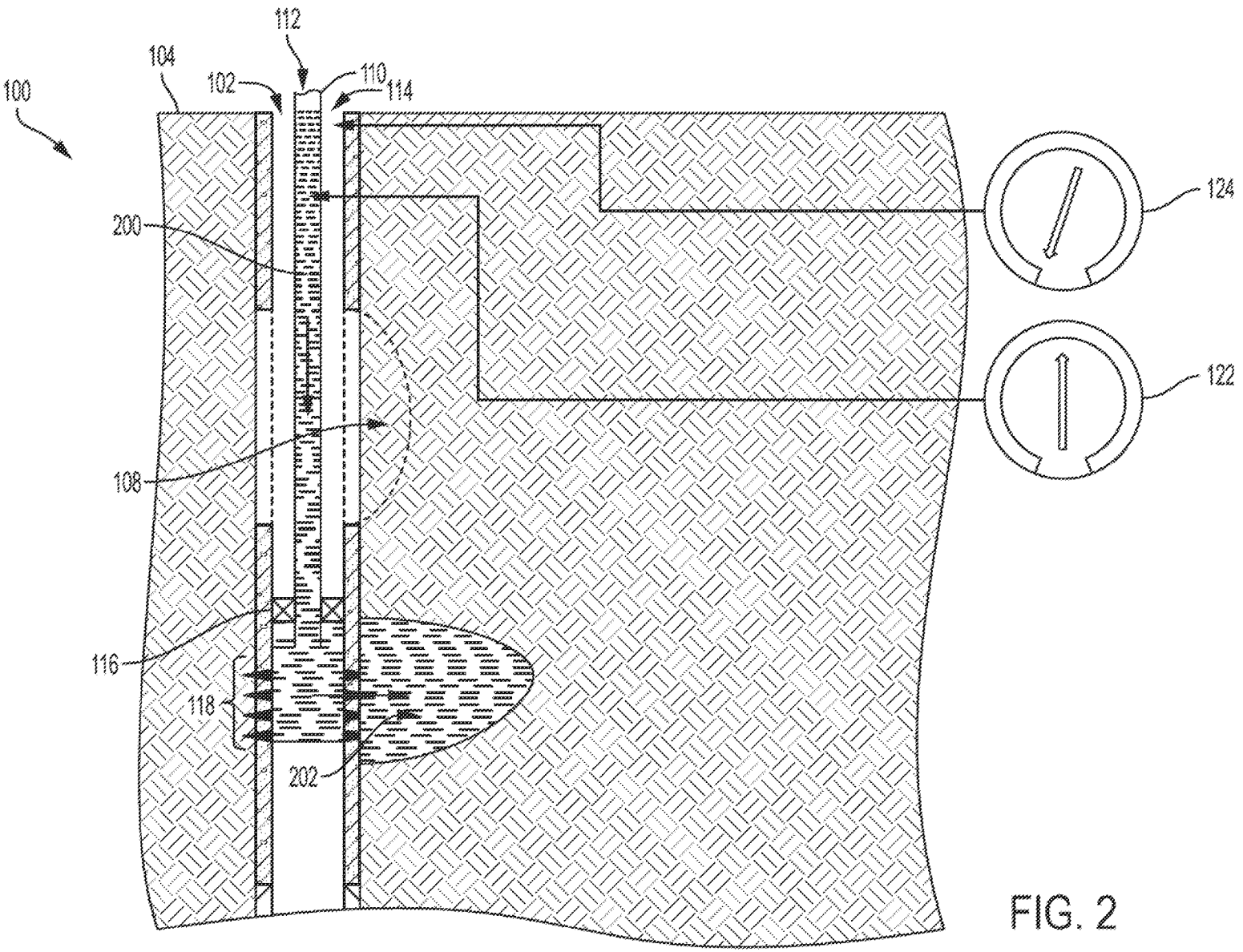
FIG. 2 is a cross-sectional schematic diagram of the wellbore environment of FIG. 1 depicting fluid injected in the wellbore to create a fracture zone below the pay zone according to one aspect of the present disclosure.

FIGS. 2-8 show schematic diagrams of the wellbore environment 100 that may illustrate portions of a process for performing a reverse frac pack treatment according to some aspects of the present disclosure. In FIG. 2, a treating fluid 200 is injected into a fracturing zone 202 through the passage 112. In some aspects, the treating fluid 200 may be routed through the passage 112 by opening a valve positioned at a surface 104 of the wellbore 102. The treating fluid 200 may include any suitable fluid or mixture of fluids to create fractures in formations adjacent to the wellbore 102. Non-limiting examples of treating fluids may include one or more water, chemical additives, gels, foams, compressed gasses (e.g., nitrogen, carbon dioxide, air, propane, etc.), liquefied petroleum gas, or combinations thereof. A downhole end of the treating tube 110 may be positioned in the wellbore proximate to the perforations 118 such that the treating fluid 200 routed through the passage 112 may be injected into the fracturing zone through the perforations 118. In some aspects, the treating fluid 200 may be pressurized to create fractures in the fracturing zone 202 that may cause the fracturing zone 202 to expand. The pressure-gauge assembly 122 communicatively coupled to the passage 112 may indicate an increase in pressure in the passage 112 as the treating fluid 200 is routed through the passage 112. The isolation device 116 may block the treating fluid 200 flowing through the passage 112 from leaking or otherwise penetrating the passage 114. The pressure-gauge assembly 124 communicatively coupled to the passage 114 may indicate an undisturbed condition in the passage 114 and across the screen 120. The treating fluid 200 may continue to create additional fractures in the fracturing zone 202 to expand the fracturing zone 202. In some aspects, the fracturing zone 202 may expand outward away from the wellbore 102 and upward toward the pay zone 108.

Figure 3:
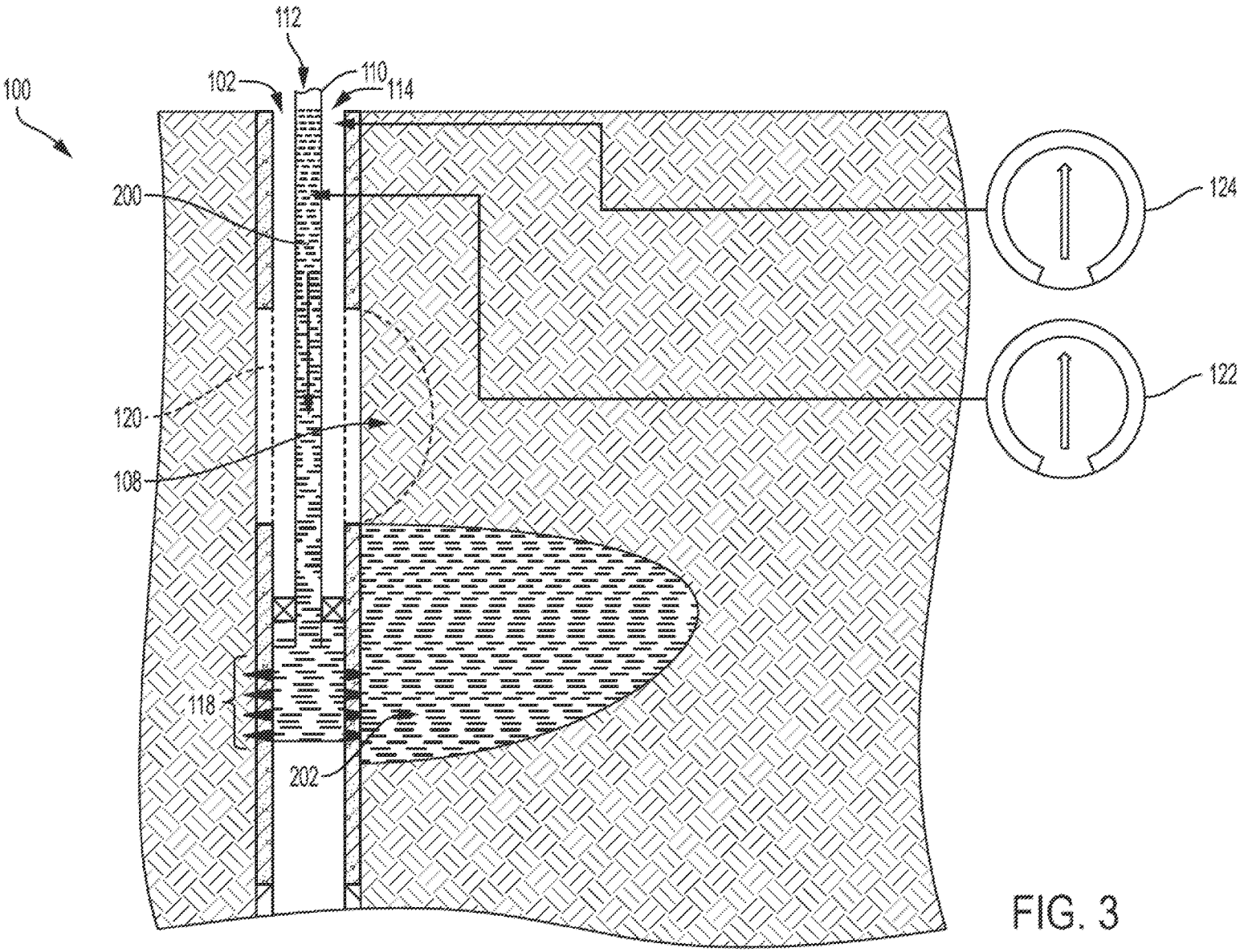
FIG. 3 is a cross-sectional schematic diagram of the wellbore environment of FIG. 2 depicting fluid injected in the wellbore to upwardly expand the fracture zone according to one aspect of the present disclosure.

For example, FIG. 3 shows the fracturing zone 202 expanded toward the pay zone 108 such that the fracturing zone 202 begins to penetrate into the pay zone 108. As the fracturing zone 202 penetrates the pay zone 108, fluid communication may be established between the fracturing zone 202 and the passage 114. The pressure-gauge assemblies 122, 124 may indicate that the fracturing zone 202 has penetrated the pay zone 108 by showing equalized pressure in the passages 112, 114 as shown in FIG. 3. In some aspects, the treating fluid 200 may begin to leak into the passage 114 through the screen 120.

Figure 4:
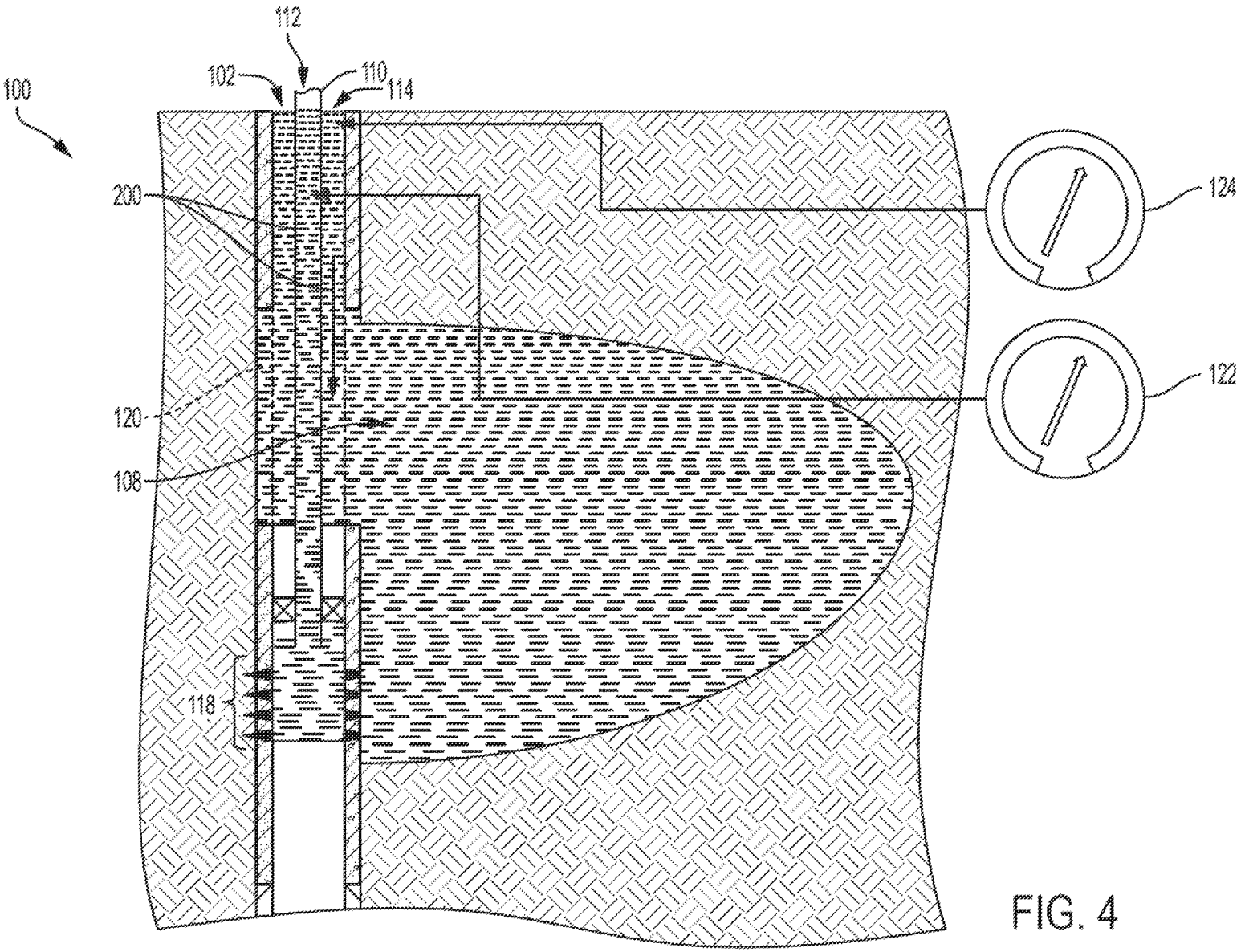
FIG. 4 is a cross-sectional schematic diagram of the wellbore environment of FIG. 3 depicting fluid injected into the pay zone and fracture zone simultaneously to expand the pay zone according to one aspect of the present disclosure.

In some aspects, the treating fluid 200 may continue to be injected into the fracturing zone 202 solely through the passage 112 to further expand the fracturing zone 202 outward, away from the wellbore 102. Alternatively, treating fluid 200 may also be routed into the pay zone 108 through the passage 114 to expand the pay zone 108 as shown in FIG. 4. Upon the fracturing zone 202 expanding into the pay zone 108 as shown in FIG. 3, the pay zone 108 may be enlarged such that the pay zone 108 includes the fracturing zone 202. As shown in FIG. 4, the treating fluid 200 may be simultaneously routed through both of the passages 112, 114 to further expand the pay zone 108 both upward and outward by injecting the treating fluid 200 into the pay zone 108 to create additional fractures. The treating fluid 200 may continue to be injected into the pay zone 108 through the passages 112, 114 until a desired size and shape of the pay zone 108 is achieved. In some aspects, an operator may inject the treating fluid 200 into the pay zone at different rates to control the manner in which the pay zone 108 expands. For example, the operator may adjust the valves connected to each of the passages 112, 114 allow the treating fluid 200 to be routed through the passage 112 at a flow rate that is different than the rate of flow of the treating fluid through the passage 114. The flow rate differential between the passages 112, 114 may cause the pay zone 108 to expand in different directions at different rates to cause the pay zone to have a desired shape. In some aspects, the pressure-gauge assemblies 122, 124 may continue to show an equalized pressure in the passages 112, 114 as shown in FIG. 4.

Figure 5:
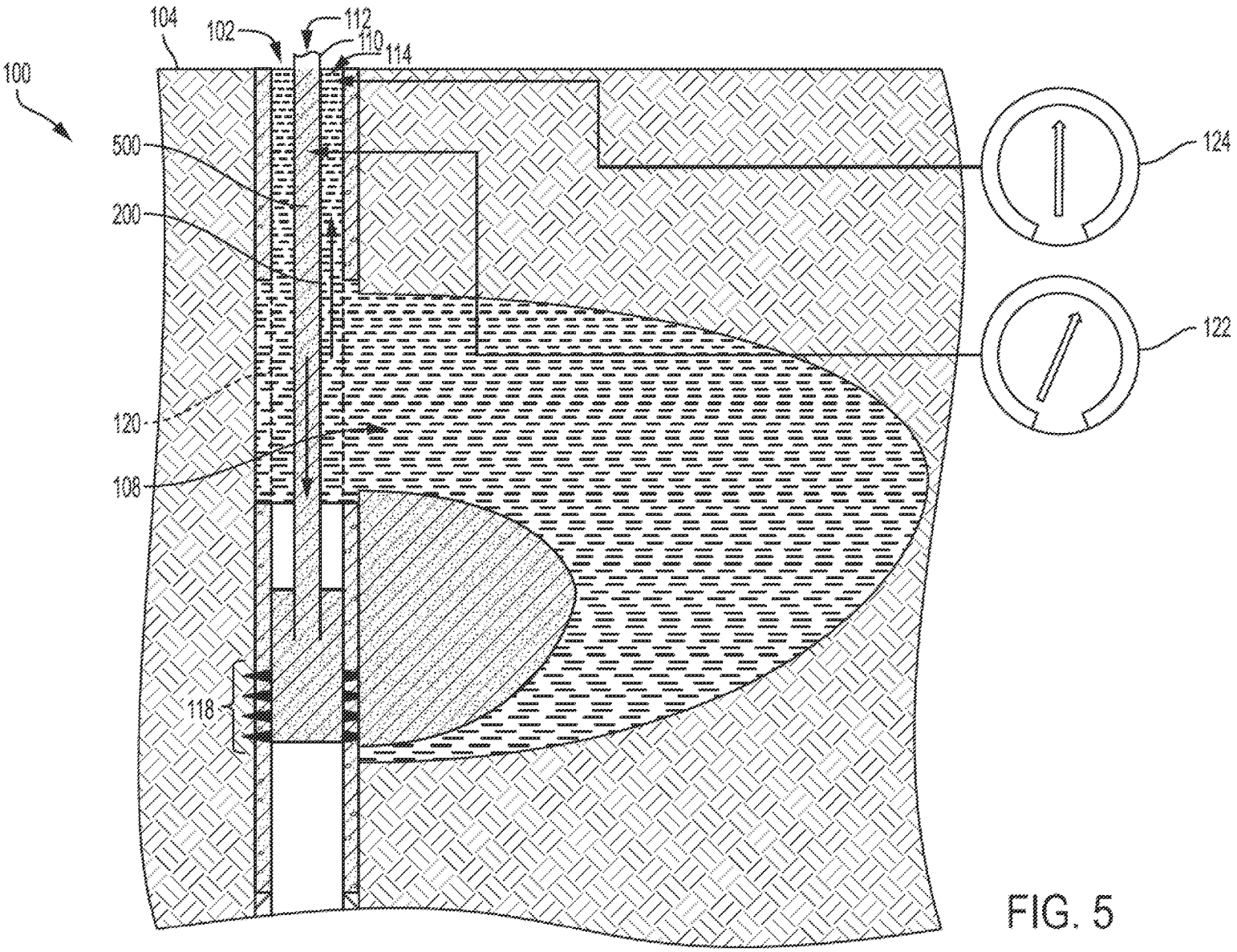
FIG. 5 is a cross-sectional schematic diagram of the wellbore environment of FIG. 4 depicting proppant injected into the expanded pay zone and a reverse flow of the fluid from the pay zone according to one aspect of the present disclosure.

In FIG. 5, proppant 500 is routed through the passage 112 and deposited into the pay zone 108 through the perforations 118. The proppant 500 may be a solid material that may be deposited into the fractures formed in the pay zone 108 to prevent the fractures from collapsing or otherwise closing during or following a fracturing treatment. In some aspects, the proppant 500 may be sand, treated sand, a ceramic material, bauxite material, or other particles sized and shaped to provide to maintain the fractures in the pay zone 108. The proppant 500 may also be shaped and sized to provide a conduit for production of fluid (e.g., hydrocarbons) from the pay zone 108. For example, the proppant 500 may function as a filter to permit the release of hydrocarbons and prevent additional materials in the formation of the pay zone from traveling through the proppant 500. In some aspects, the proppant 500 may be included in a fluid (e.g., treating fluid 200) to route the proppant 500 through the passage 112. The proppant 500 may fill an downhole portion of the wellbore 102 proximate to a downhole end of the treating tube 110 and enter into fractures in the pay zone 108 through the perforations 118. As the proppant 500 is routed into the pay zone 108, the flow of the treating fluid 200 through the passage 114 may be reversed to allow the flow of the treating fluid out of the pay zone 108 and toward the surface 104 of the wellbore 102.

In some aspects, the flow may be reversed in a manner to control the flow back of the treating fluid 200 from the pay zone 108 into the passage 114 and towards the surface. In some aspects, the flow may be reversed in any known manner, including, but not limited to manipulation of a valve or fluid pump connected to the passage 114. In additional and alternative aspects, reversing the flow of the treating fluid 200 through the passage 114 may be passively (or semi-passively) performed by discontinuing the flow of the treating fluid 200 toward the pay zone 108. The proppant 500 may be deposited into the pay zone 108 in a manner to displace the treating fluid 200 in the pay zone 108 and cause the treating fluid 200 to flow back toward the surface 104 of the wellbore 102 through the passage 114.

The pressure-gauge assembly 122 may continue to indicate a fracturing pressure in the passage 112. In some aspects, the pressure in the passage 112 may be slightly decreased in comparison to the pressure in the passage 112 during fracturing of the pay zone 108 by the treating fluid 200 as shown in FIG. 4. The pressure-gauge assembly 124 may indicate a decrease in pressure in the passage 114 as the flow of the treating fluid 200 is reversed. The pressure in the passage 114 may be higher in the passage 112 than in the passage 114 as shown by the pressure-gauge assemblies 122, 124, respectively, in FIG. 5.

Figure 6:
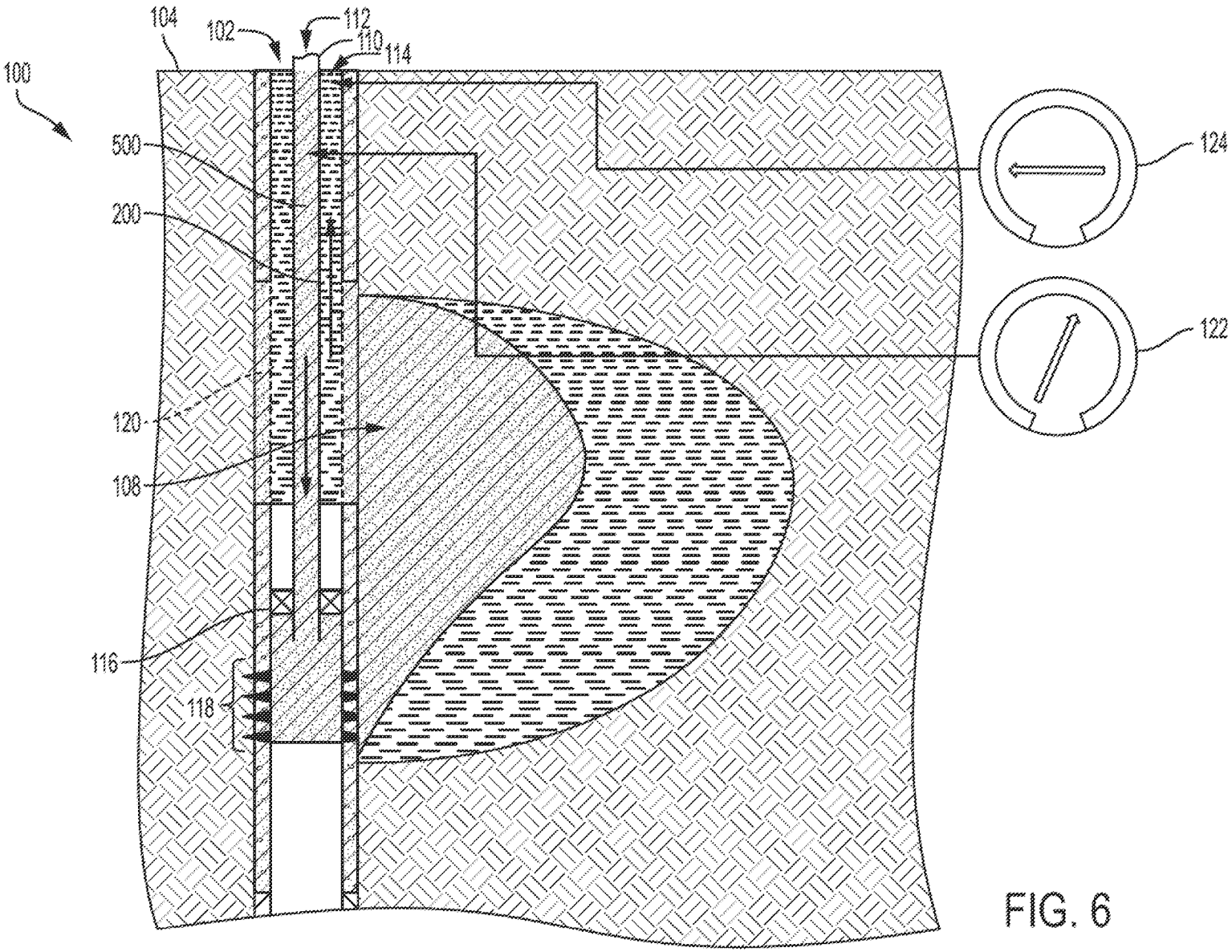
FIG. 6 is a cross-sectional schematic diagram of the wellbore environment of FIG. 5 depicting proppant injected into the pay zone to shape the pay zone according to one aspect of the present disclosure.

The proppant 500 may continue to be routed through the passage 112 and deposited in the fractures of the pay zone 108 as shown in FIG. 6. The proppant 500 may expand upward into the pay zone 108. As the proppant 500 expands in the pay zone 108, the proppant 500 may begin to expand across the pay zone 108 side of the screen 120. The screen 120 may prevent the proppant form entering the passage 114, causing the proppant to expand outward away from the screen 120. The pressure-gauge assemblies 122, 124 may indicate an additional drop in the pressure in the passage 114 as the proppant 500 covers the pay zone 108 side of the screen 120. The drop in pressure in the passage 114 may be in response to the inhibited flow of the treating fluid 200 from the pay zone 108 into the passage 114 as the treating fluid 200 is required to flow through the proppant 500. In some aspects, the pressure in the passages 112, 114 may be adjusted to control the shape formed by the proppant 500 in the pay zone 108, the amount of proppant 500 being is deposited in fractures in the pay zone 108, and the rate at which the proppant 500 is deposited in the fractures.

Figure 7:
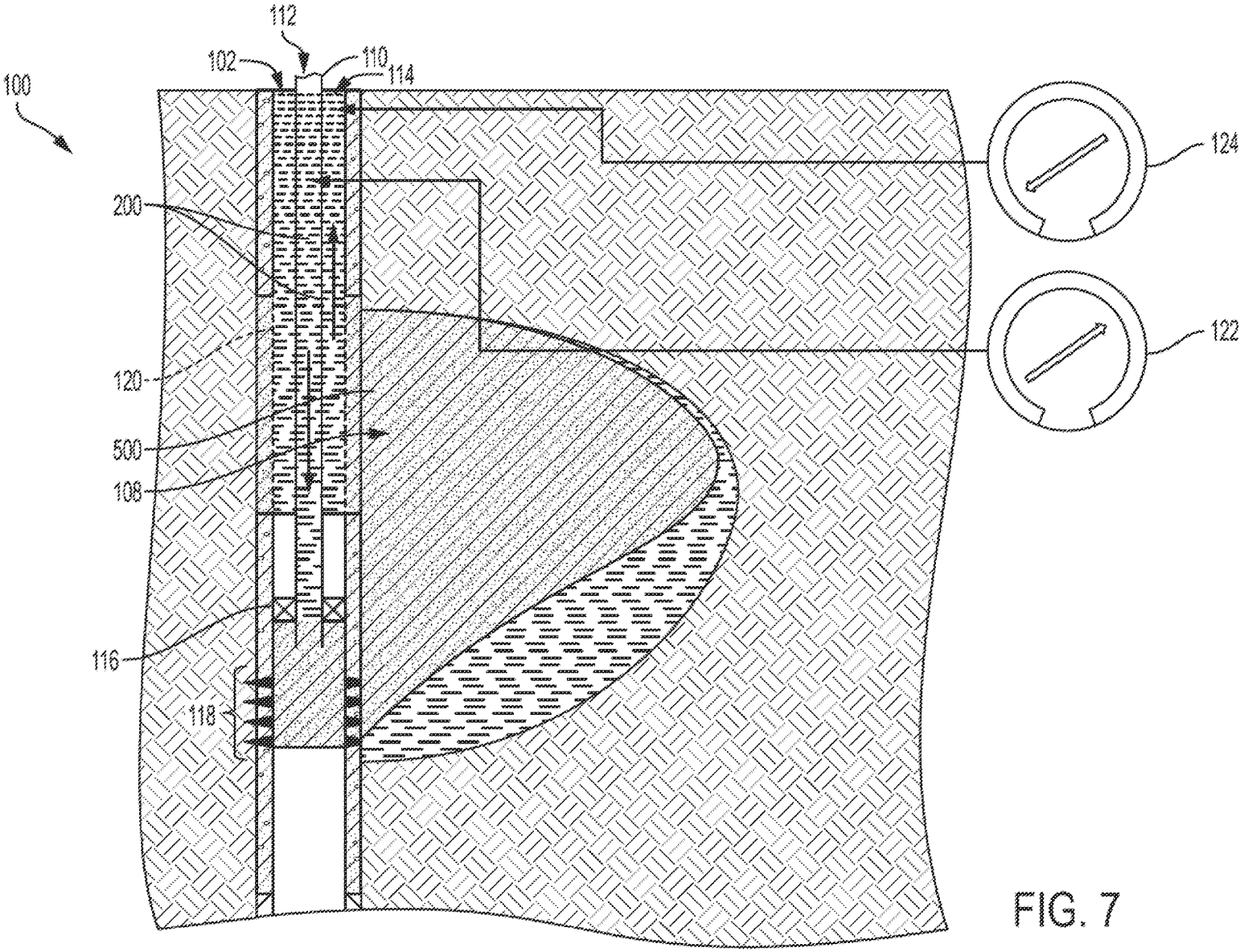
FIG. 7 is a cross-sectional schematic diagram of the wellbore environment of FIG. 6 depicting fluid injected into the wellbore to displace proppant from a treating tube according to one aspect of the present disclosure.
Figure 8:
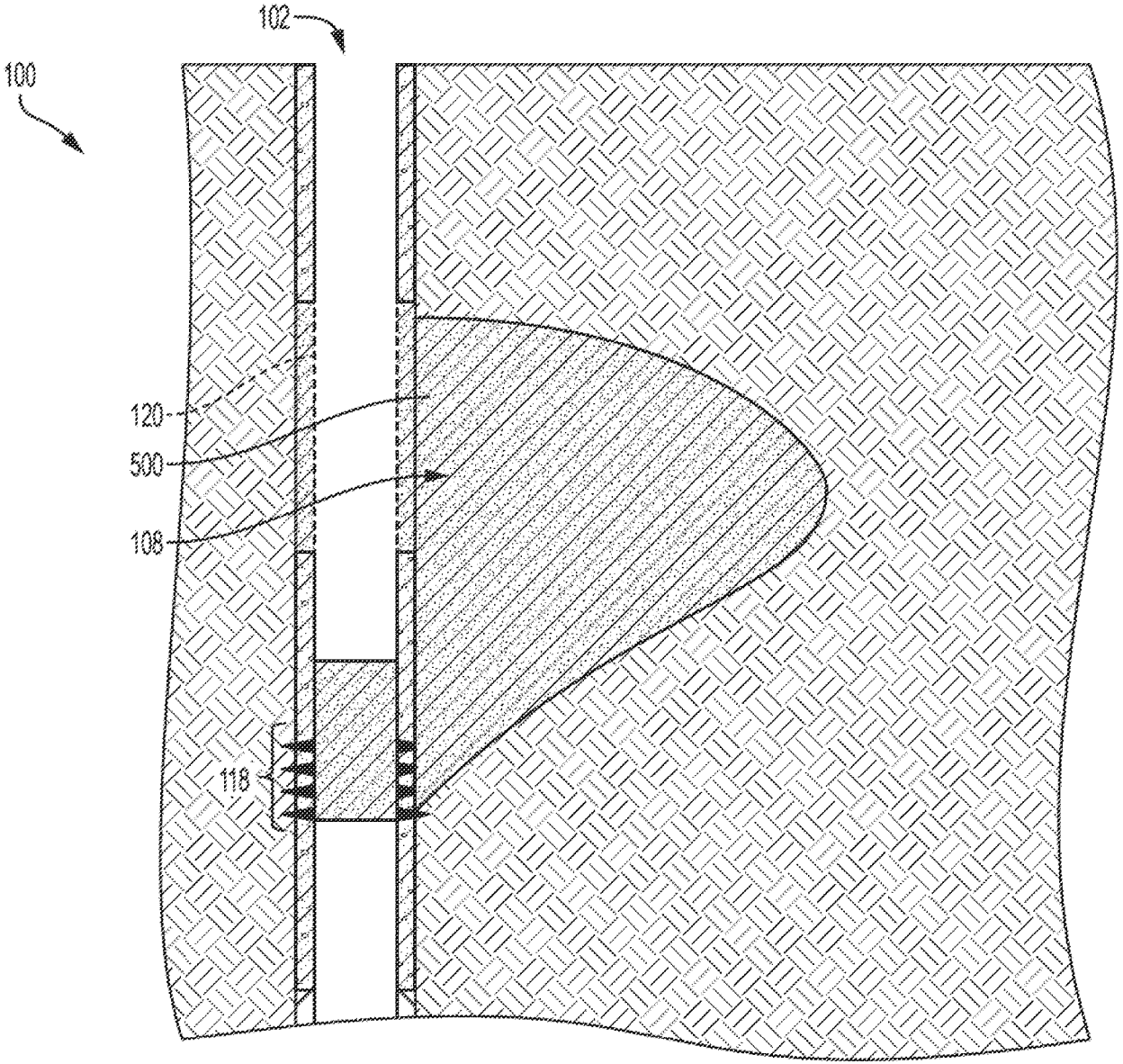
FIG. 8 is a cross-sectional schematic diagram of the wellbore environment of FIG. 1 depicting a completed wellbore according to one aspect of the present disclosure.

In FIG. 7, the desired amount of proppant 500 is deposited in the pay zone 108. The treating fluid 200 may be routed through the passage 112 to displace any remaining proppant 500 from the passage 112. The treating fluid 200 remaining in the pay zone 108 may continue to flow from the pay zone 108 into the passage 114 through the screen 120. The pressure-gauge assembly 122 may indicate an increase in pressure in the passage 112 and the pressure-gauge assembly 124 may indicate a significant decrease in pressure in the passage 114. In some aspects, the pressure differential between the passages 112, 114 may reflect the complete packing of the proppant 500 in the fractures of the pay zone 108. Subsequent to completion of the reverse frac pack treatment, the treating tube 110 and the isolation device 116 may be removed from the wellbore 102 as shown in FIG. 8. The fractures created in the pay zone 108 may be retained by the proppant 500. The proppant 500 may be prevented from entering the wellbore 102 from the pay zone 108 by the screen 120 positioned at the opening of the pay zone 108. In some embodiments, the isolation device 116 may remain in the wellbore 102. For example, the isolation device 116 may include a bridge plug having a check valve and a stinger that may be left in the wellbore 102 to prevent the production of fluid and proppant from the perforations 118 during the production stage of the wellbore environment 100.

Figure 9:
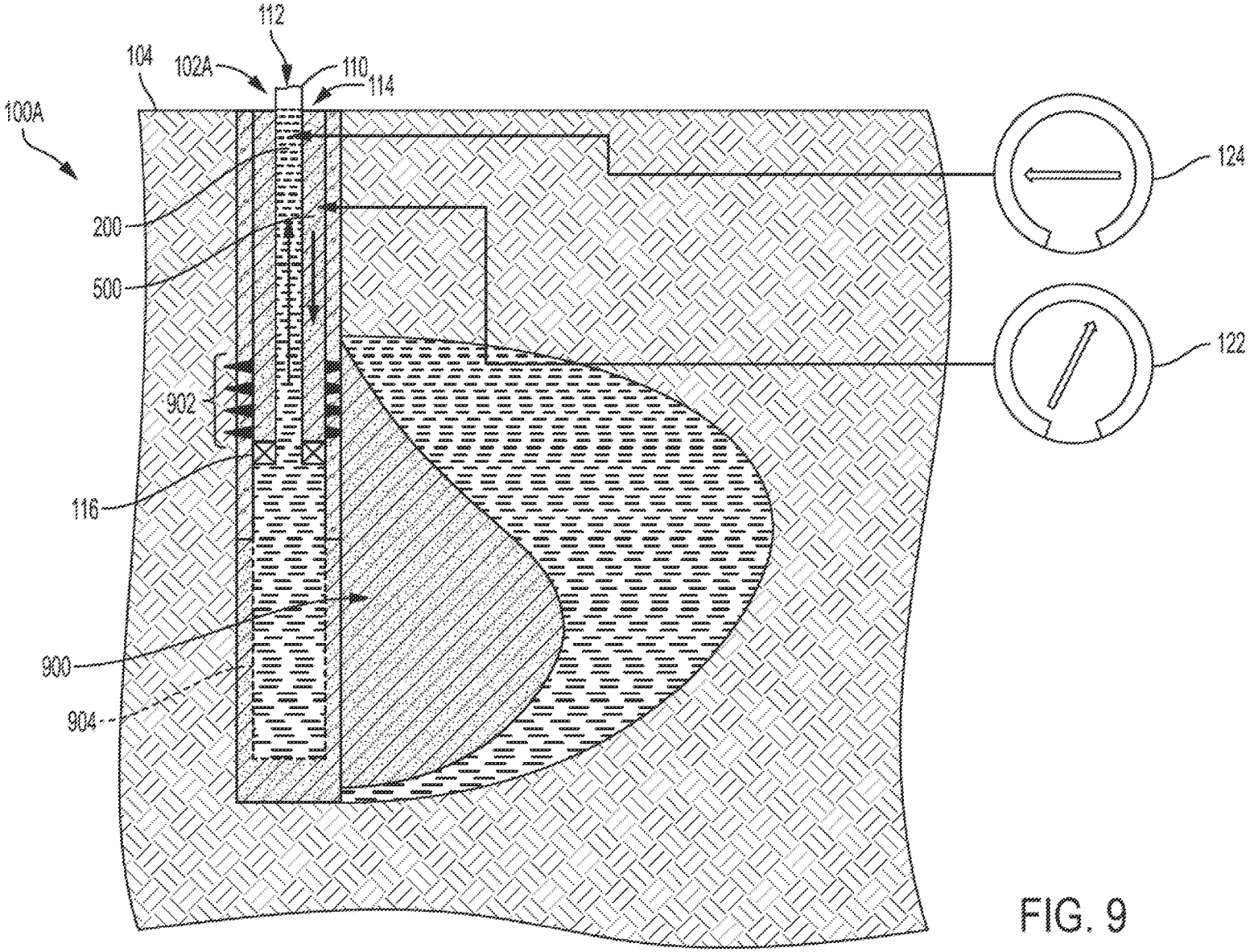
FIG. 9 is a cross-sectional schematic diagram depicting an example of a wellbore environment including a pay zone expanded from a fracturing zone above the pay zone according to one aspect of the present disclosure.

Although the reverse frac pack treatment process is described as expanding a pay zone from a fracturing zone below the pay zone, the process may be similarly performed by expanding the pay zone from a fracturing zone above the pay zone. For example, FIG. 9 shows a schematic diagram of a wellbore environment 100A having a pay zone 900 expanded form a fracturing zone above the pay zone 900. Similar to the wellbore environment 100 shown in FIGS. 1-8, a wellbore 102A may include a cemented casing 106 set along the wall of the wellbore 102A. But, instead of the perforations 118 providing an entry point to a fracturing zone below the pay zone 108 as shown in FIG. 1, perforations 902 may be positioned in the casing 106 of the wellbore 102A uphole of the pay zone 900. The perforations 902 may allow the treating fluid 200 to create fractures from above the pay zone 900 that may be expanded downhole. A screen 904 is positioned across the pay zone 900 to block the proppant 500 from flowing uphole in the passage 112. The screen 904 is positioned downhole of the isolation device 116.

The treating tube 110 may be positioned in the wellbore 102A as described with respect to FIG. 1 to create the passages 112, 114. But, the function of the passages 112, 114 may be reversed. For example, referring back to FIGS. 3-5 for comparison, in the wellbore environment 100 in FIG. 3, the treating fluid 200 is routed through the passage 112 and into the fracturing zone 202 through the perforations 118. In FIG. 4, treating fluid 200 is additionally routed through the passage 114 and into the pay zone 108 (including the fracturing zone 202) through the screen 120. In FIG. 5, the proppant 500 is routed through the passage 112 and into the pay zone 108 through the perforations 118. But, in the wellbore environment 100A shown in FIG. 9, the treating fluid 200 may be routed through the passage 114 and into a fracturing zone above the pay zone 900 through the perforations 902. Subsequent to the fracturing zone expanding into the pay zone 900, additional treating fluid 200 may be routed through the passage 112 into the pay zone 900 through the screen 904. The proppant 500 is routed through the passage 114 and into the pay zone 900 through the perforations 902 as shown in FIG. 9, with the flow of the treating fluid 200 being reversed in the passage 112 to allow the treating fluid 200 to flow out of the pay zone 900 to the surface 104.

Figure 10:
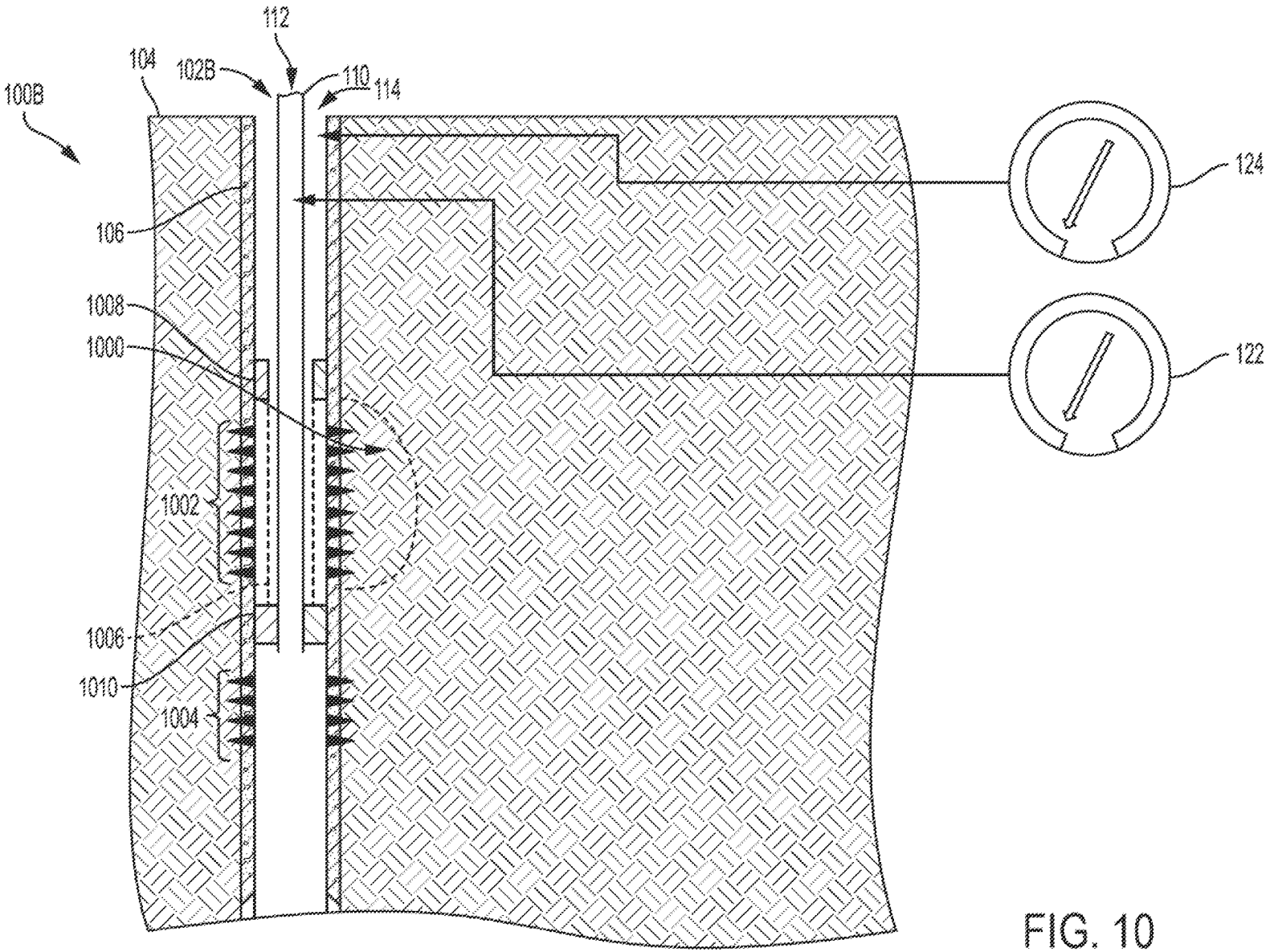
FIG. 10 is a cross-sectional schematic diagram depicting an example of a wellbore environment including a reverse frac pack treatment system for re-fracturing a cemented wellbore according to one aspect of the present disclosure.
Figure 11:
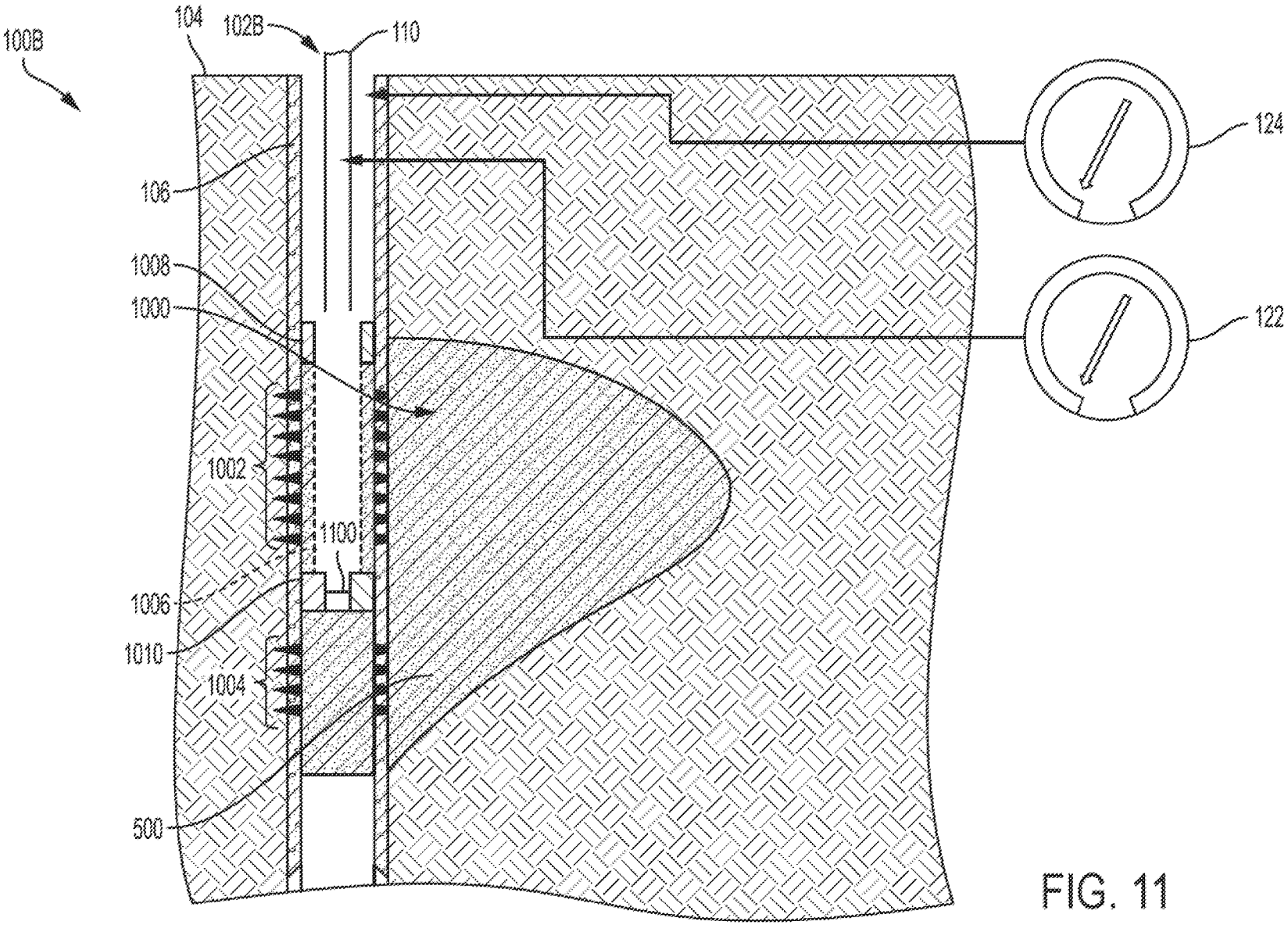
FIG. 11 is a cross-sectional schematic diagram of the wellbore environment of FIG. 10 depicting a completed wellbore according to one aspect of the present disclosure.

FIGS. 10-11 show schematic diagrams illustrating an example of a wellbore environment 100B including a wellbore 102B. In some aspects, the wellbore 102B may have been previously treated or completed. The wellbore 102B may be adjacent to a pay zone 1000. Perforations 1002 may be included in the cemented casing 106 to create an opening to the pay zone 1000. Additional perforations 1004 may be included downhole of the perforations 1002 to create an entry point for treating fluid 200 to create fractures below the pay zone 1000 that may be expanded upward into the pay zone 1000. A screen 1006 may be positioned across the perforations 1002. The screen 1006 may be coupled to isolation devices 1008, 1010. Isolation device 1008 may be positioned uphole of the perforations 1002 and isolation device 1010 may be positioned downhole of the perforations 1002 to allow the screen to extend across the perforations 1002 as shown in FIG. 10. In some aspects, the isolation devices 1008, 1010 may include bridge plugs positionable in the passage 114. In additional and alternative aspects, the isolation device 1008 may allow fluid to treating fluid 200 or proppant 500 to flow in the passage 114 around the isolation device 1008. The isolation device 1010 may isolate the passage 114 from the passage 112 and prevent treating fluid 200 and proppant 500 from flowing from the passage 114 into the passage 112 or downhole in the wellbore 102.

The treating tube 110 may be positioned in the wellbore 1028 to create the passages 112, 114. A downhole end of the treating tube 110 may be positioned internal to the isolation device 1010 to establish isolation between the passages 112, 114. The reverse frac packing treatment process may proceed similar to the process described with respect to FIGS. 2-8. For example, the treating fluid 200 may be routed through the passage 112 and into a fracturing zone below the pay zone 1000 though the perforations 1004. The treating fluid 200 may create fractures in the formation below the pay zone 1000 and the fractures may be expanded to extend uphole toward the pay zone 1000. Once the treating fluid 200 is in communication with the perforations 1002 and the passage 114, treating fluid 200 may be routed through the passage 114 into the pay zone 1000 to further expand the pay zone 1000. Proppant 500 may be routed through the passage 112 and the flow of the treating fluid 200 through the passage 114 may be reversed to allow the treating fluid 200 to flow through the passage 114 towards the surface 104.

FIG. 11 shows an example of the pay zone 1000 completed with the proppant 500 in the pay zone 1000 and fully packed across the screen 1006. The treating tube 110 may be disconnected from the isolation device 1010 and removed from the wellbore 102B. In some aspects, a valve 1100 may be positioned internal to the isolation device 1010 and closed to prevent the proppant 500 from the perforation 1004 from entering in subsequent productions from the wellbore 102B. The valve 1100 may include a check valve, a profiled nipple, an upside-down flapper, a ball valve, a plug, or another other type of valve suitable for preventing the proppant 500 from entering a production. The screen 1006 may remain downhole in the wellbore 102B to maintain the proppant 500 in the pay zone 1000. Although the reverse frac packing treatment process is described in FIGS. 10-11 as expanding the pay zone 1000 from below the pay zone 1000, the pay zone 1000 may similarly be expanded from above the pay zone 1000 in the wellbore 102B as described with respect to FIG. 9.

In some aspects, systems and methods may be provided according to one or more of the following examples:

Example #1

A method may include positioning a treating tube in a wellbore to create a first passage and a second passage. The method may also include isolating the first passage from the second passage. The method may also include routing treating fluid through the first passage and into a fracturing zone adjacent to the wellbore to expand the fracturing zone toward a pay zone. The method may also include routing proppant through the first passage and into the fracturing zone. The method may also include reversing a direction of flow in the second passage to allow the treating fluid in the pay zone or the fracturing zone to flow into the second passage through a screen positioned adjacent to the pay zone.

Example #2

The method of Example #1 may feature the first passage being internal to the treating tube and fluidly coupled to the fracturing zone through a perforation in a casing of the wellbore. The second passage may be an annulus between the treating tube and the casing of the wellbore and may be fluidly coupled to the pay zone through the screen.

Example #3

The method of Example #1 may feature the first passage being an annulus between the treating tube and the casing of the wellbore and being fluidly coupled to the pay zone through the screen. The second passage may be internal to the treating tube and may be fluidly coupled to the fracturing zone through a perforation in a casing of the wellbore.

Example #4

The method of Examples #1-3 may also include routing additional treating fluid through the second passage and into the pay zone to generate an expanded pay zone including the pay zone and the fracturing zone. The method may also feature reversing the direction of flow in the second passage to include allowing the treating fluid to exit the expanded pay zone through the screen.

Example #5

The method of Examples #1-4 may feature isolating the first passage from the second passage to include positioning an isolation device in the second passage and uphole of a perforation in a casing of the wellbore. The method may also feature routing the treating fluid through the first passage and into the fracturing zone to include routing the treating fluid through the perforation.

Example #6

The method of Example #5 may also include positioning the screen across a second perforation uphole of the isolation device. The method may also feature reversing the direction of flow into the second passage further to include allowing the treating fluid to flow into the second passage through the second perforation.

Example #7

The method of Example #6 may feature positioning the screen across the second perforation to include coupling the screen to the isolation device and coupling the screen to a second isolation device positioned uphole of the second perforation.

Example #8

The method of Examples #1-4 may feature isolating the first passage from the second passage to include positioning an isolation device in the first passage and downhole of a perforation in a casing of the wellbore. The method may also feature routing the treating fluid through the first passage and into the fracturing zone to include routing the treating fluid through the perforation.

Example #9

The method of Example #8 may also include positioning the screen across a second perforation downhole of the isolation device. The method may also feature reversing the direction of flow into the second passage further to include allowing the treating fluid to flow from the pay zone into the second passage through the second perforation.

Example #10 the method of Example #9 may feature positioning the screen across a second perforation to includes coupling the screen to the isolation device and coupling the screen to a second isolation device positioned downhole of the second perforation.

Example #11

The method of Examples #1-10 may also include routing additional treating fluid through the second passage and into the pay zone at the same time that the treating fluid is routed through the first passage.

Example #12

The method of Examples #1-11 may also include adjusting a pressure in the first passage to control a placement of the proppant in the fracturing zone or the pay zone.

Example #13

A system may include a treating tube positionable in a wellbore to define (i) a passage internal to the treating tube and (ii) an annulus external to the treating tube. The passage may include a downhole opening positionable in the wellbore to allow a flow of treating fluid and proppant through a perforation in a casing of the wellbore downhole of a pay zone. The system may also include an isolation device positionable in the annulus to allow a bi-directional flow of additional treating fluid into the pay zone and out of the pay zone through a screen positioned across an opening of the pay zone.

Example #14

The system of Example #13 may feature the isolation device being further positionable uphole of the perforation and downhole of the screen.

Example #15

The system of Examples #13-14 may feature the screen being couplable to the isolation device and positionable in the annulus across the opening of the pay zone. The opening may include a second perforation in the casing of the wellbore uphole of the perforation.

Example #16

The system of Examples #13-15 may feature the isolation device including a bridge plug having a valve internal to the bridge plug and closable in response to the treating tube being removed from the wellbore.

Example #17

A system may include a treating tube positionable in a wellbore to define (i) a passage internal to the treating tube and (ii) an annulus external to the treating tube. The passage may include a downhole opening positionable proximate to a pay zone to allow a bi-directional flow of treating fluid into the pay zone and out of the pay zone through a screen positioned across an opening of the pay zone. They system may also include an isolation device positionable in the annulus to allow a flow of treating fluid and proppant through a perforation in a casing of the wellbore uphole of the pay zone.

Example #18

The system of Example #17 may feature the isolation device being further positionable downhole of the perforation and uphole of the screen.

Example #19

The system of Examples #17-18 may feature the screen being couplable to the isolation device and positionable in the annulus across the opening of the pay zone. The opening may include a second perforation in the casing of the wellbore downhole of the perforation.

Example #20

The system of Examples #17-19 may also include one or more pressure-gauge assemblies communicatively coupled to the passage and the annulus to monitor pressure in the passage and the annulus.

The foregoing description of the examples, including illustrated examples, has been presented only for the purpose of illustration and description and is not intended to be exhaustive or to limit the subject matter to the precise forms disclosed. Numerous modifications, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A method, comprising:

positioning a treating tube in a wellbore to create a first passage and a second passage;

segmenting the wellbore into a first segment and a second segment using an isolation device, wherein the first segment includes a first perforation through a wall of the wellbore into a fracturing zone, and wherein the second segment includes a second perforation through the wall of the wellbore into a pay zone having hydrocarbons;

isolating the first passage from the second passage using the isolation device;

expanding the fracturing zone toward the pay zone by routing treating fluid through the first passage and the first perforation into the fracturing zone, thereby establishing fluid communication between the fracturing zone and the pay zone such that at least some of the treating fluid enters the pay zone;

routing proppant through the first passage and the first perforation into the fracturing zone; and routing the treating fluid from the pay zone into the second passage through a screen coupled across the second perforation associated with the pay zone.

2. The method of claim 1, wherein the first passage is internal to the treating tube and fluidly coupled to the fracturing zone through the first perforation, wherein the first perforation is in a casing of the wellbore, and wherein the second passage is an annulus between the treating tube and the casing of the wellbore and is fluidly coupled to the pay zone through the screen.

3. The method of claim 1, wherein the first passage is an annulus between the treating tube and a casing of the wellbore, wherein the first passage is fluidly coupled to the fracturing zone through the first perforation, and wherein the second passage is internal to the treating tube and fluidly coupled to the pay zone through the second perforation and the screen.

4. The method of claim 1, further including:

routing additional treating fluid through the second passage and into the pay zone to generate an expanded pay zone including the pay zone and the fracturing zone; and pumping the treating fluid from the expanded pay zone through the screen into the second passage.

5. The method of claim 1, wherein isolating the first passage from the second passage includes positioning the isolation device in the second passage and uphole of the first perforation in a casing of the wellbore.

6. The method of claim 5, further including positioning the screen across the second perforation uphole of the isolation device.

7. The method of claim 6, wherein positioning the screen across the second perforation includes:

coupling the screen to the isolation device; and coupling the screen to a second isolation device positioned uphole of the second perforation.

8. The method of claim 1, wherein isolating the first passage from the second passage includes positioning the isolation device in the first passage and downhole of the first perforation in a casing of the wellbore.

9. The method of claim 8, further including positioning the screen across the second perforation downhole of the isolation device.

10. The method of claim 9, wherein positioning the screen across the second perforation includes:

coupling the screen to the isolation device; and coupling the screen to a second isolation device positioned downhole of the second perforation.

11. The method of claim 1, further including routing additional treating fluid through the second passage and into the pay zone at the same time that the treating fluid is routed through the first passage.

12. The method of claim 1, further including adjusting a pressure in the first passage to control a placement of the proppant in the fracturing zone or the pay zone.

13. A system, comprising:

an isolation device positioned in a wellbore for segmenting the wellbore into a first segment and a second segment, wherein the first segment includes a first perforation through a wall of the wellbore into a fracturing zone, and wherein the second segment includes a second perforation through the wall of the wellbore into a pay zone having hydrocarbons;

a treating tube positioned in the wellbore to define (i) a passage internal to the treating tube and (ii) an annulus external to the treating tube, the passage including an opening that is positioned in the first segment of the wellbore for transmitting treating fluid and proppant through the first perforation into the fracturing zone, wherein the second perforation in the second segment of the wellbore is for receiving the treating fluid out from the pay zone;

a screen coupled across the second perforation associated with the pay zone; and a pump configured to transmit the treating fluid through the treating tube into the fracturing zone for expanding the fracturing zone into the pay zone.

14. The system of claim 13, wherein the isolation device is positioned uphole of the first perforation and downhole of the screen.

15. The system of claim 13, wherein the screen is coupled to the isolation device and positioned in the annulus across the second perforation associated with the pay zone, the second perforation being uphole of the first perforation in the first segment.

16. The system of claim 15, wherein the isolation device includes a bridge plug having a valve internal to the bridge plug, the valve being closable in response to the treating tube being removed from the wellbore.

17. A system, comprising:

an isolation device positioned in a wellbore to segment the wellbore into a first segment and a second segment, wherein the first segment includes a first perforation through a wall of the wellbore into a fracturing zone, and wherein the second segment includes a second perforation through the wall of the wellbore into a pay zone having hydrocarbons;

a treating tube positioned in the wellbore to define (i) a passage internal to the treating tube and (ii) an annulus external to the treating tube, the passage including an opening positioned in the second segment of the wellbore for receiving treating fluid out from the pay zone through the second perforation, wherein the first perforation in the first segment of the wellbore is for transmitting the treating fluid into the fracturing zone;

a screen coupled across the second perforation associated with the pay zone; and a pump configured to transmit the treating fluid through the annulus into the fracturing zone for expanding the fracturing zone into the pay zone.

18. The system of claim 17, wherein the isolation device is positioned downhole of the first perforation and uphole of the second perforation.

19. The system of claim 17, further comprising one or more pressure-gauge assemblies communicatively coupled to the passage and the annulus to monitor pressure in the passage and the annulus.

* * * * *